US009861990B2

(12) United States Patent
Wiser

(10) Patent No.: US 9,861,990 B2
(45) Date of Patent: Jan. 9, 2018

(54) HIGH VOLTAGE CONNECTION FOR SPARSE MATERIAL

(71) Applicant: Environmental Management Confederation, Inc., Rocky Hill, NJ (US)

(72) Inventor: Forwood C Wiser, Kingston, NJ (US)

(73) Assignee: Environmental Management Confederation, Inc., Rocky Hill, NJ (US)

( * ) Notice: Subject to any disclaimer, the term of this patent is extended or adjusted under 35 U.S.C. 154(b) by 120 days.

(21) Appl. No.: 14/945,573

(22) Filed: Nov. 19, 2015

(65) Prior Publication Data

US 2016/0144379 A1 May 26, 2016

Related U.S. Application Data

(60) Provisional application No. 62/082,407, filed on Nov. 20, 2014.

(51) Int. Cl.

| | |
|---|---|
| ***B03C 3/66*** | (2006.01) |
| ***B03C 3/70*** | (2006.01) |
| ***B03C 3/155*** | (2006.01) |
| ***B03C 3/09*** | (2006.01) |

(52) U.S. Cl.

CPC ..... *B03C 3/66* (2013.01); *B03C 3/09* (2013.01); *B03C 3/155* (2013.01); *B03C 3/70* (2013.01)

(58) Field of Classification Search

CPC combination set(s) only.

See application file for complete search history.

(56) References Cited

U.S. PATENT DOCUMENTS

| | | | | |
|---|---|---|---|---|
| 3,509,696 | A * | 5/1970 | Thompson | B03C 3/155 55/487 |
| 4,886,526 | A * | 12/1989 | Joannou | B03C 3/155 96/67 |
| 5,474,599 | A * | 12/1995 | Cheney | B03C 3/155 95/63 |
| 5,573,577 | A | 11/1996 | Joannou | |
| 6,077,334 | A * | 6/2000 | Joannou | B03C 3/155 96/66 |
| 6,989,051 | B2 | 1/2006 | Parisi et al. | |
| 7,708,813 | B2 | 5/2010 | Wiser et al. | |
| 2003/0164095 | A1 | 9/2003 | Joannou | |
| 2010/0326279 | A1 | 12/2010 | Wiser et al. | |
| 2011/0277637 | A1* | 11/2011 | Chesebrough | B03C 3/09 96/96 |
| 2013/0183201 | A1 | 7/2013 | Wiser et al. | |

FOREIGN PATENT DOCUMENTS

| | | |
|---|---|---|
| CA | 2826992 | 4/2015 |

* cited by examiner

*Primary Examiner* — Duane Smith
*Assistant Examiner* — Sonji Turner
(74) *Attorney, Agent, or Firm* — Spruce Law Group, LLC

(57) ABSTRACT

A filter assembly for an active field polarized media air cleaner includes a conductive screen that conducts a high voltage therethrough, a probe that delivers voltage to the conductive screen, and a conductive patch adhered to the conductive screen. The probe delivers the high voltage to the conductive screen through the conductive patch.

19 Claims, 3 Drawing Sheets

HIGH VOLTAGE CONNECTION FOR SPARSE MATERIAL

BACKGROUND

The principal of electrostatic attraction has been used for many years to enhance the removal of contaminants from air streams. There are three primary categories of air electrostatic cleaners: electrostatic precipitators, passive electrostatic filters and active field polarized media air cleaners, which are sometimes known under different terms.

Electrostatic precipitators charge particles and then capture them on oppositely charged and/or grounded collection plates.

A passive electrostatic filter (also know as an electret) employs a media (or combination of different media) that through some combination of treatment and/or inherent properties has an electrostatic charge. Particles entering the filter media that have an electrostatic charge are attracted to the charged media filter materials that have the opposite electrostatic charge.

In a polarized media air cleaner described for example in U.S. Pat. No. 7,708,813 and 2012/0260803, both of which are incorporated by reference as if fully set forth herein, a voltage differential between elements is used to create an electrostatic field that polarizes the fibers of a media pad and the surface charge of airborne contaminants. This significantly enhances capture and loading of the contaminants. In these systems, there is a high voltage connection between a high-voltage power supply and a probe centrally-located conductive screen of a media pad positioned between grounded exterior screens. The connection is critical to the function of the overall system as the voltage differential between the center screen and the ground screen(s) creates the electrostatic field. This connection point, however, can be a weak point in the system and may fail, rendering the polarizing feature in the air cleaner ineffective.

The reason that this can be a failure point is because the filter material itself is often a sparse material. Because air must pass through the system with as little resistance as possible, screens and other materials in a filter may be made from sparse material. This does not make for a solid electrical connection. Further, some of the byproducts of an incomplete connection are arcing, ionization, and ozone production. All of these will tend to breakdown a variety of materials and further exacerbate the problem. Therefore, if the center screen is a relatively sparse material and the high-voltage probe is relatively small, it may be difficult to assure a reliable connection between the two.

Thus, any object connected to the material including a conductive probe becomes a stress point in a sparse and minimally tough material.

SUMMARY OF THE EMBODIMENTS

This connection point is critical to a polarized air cleaner's performance. The current invention relates to making good electrical contact between an electrical source and a relatively sparse filter material.

A filter assembly for an active field polarized media air cleaner includes a conductive screen that conducts a high voltage therethrough, a probe that delivers voltage to the conductive screen, and a conductive patch adhered to the conductive screen. The probe delivers the high voltage to the conductive screen through the conductive patch.

DETAILED DESCRIPTION OF THE EMBODIMENTS

An active field polarized media air cleaner uses an electrostatic field created by a voltage differential. The electrostatic field polarizes both the media fibers and the particles that enter, thereby increasing the removal efficiency of the media as well as the loading capacity of the air cleaner. A dielectric material is an electrical insulator or a substance that is highly resistant to electric current that can also store electrical energy. A dielectric material tends to concentrate an applied electric field within itself and is thus an efficient supporter of electrostatic fields.

Figure 1:
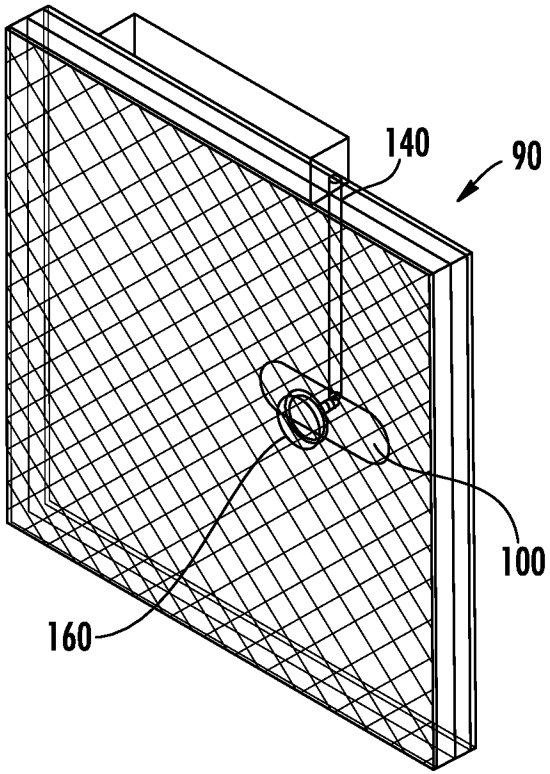
FIG. 1 shows an isometric view of the conductive disc applied to a screen, with certain elements shown transparently for clarity.
Figure 2:
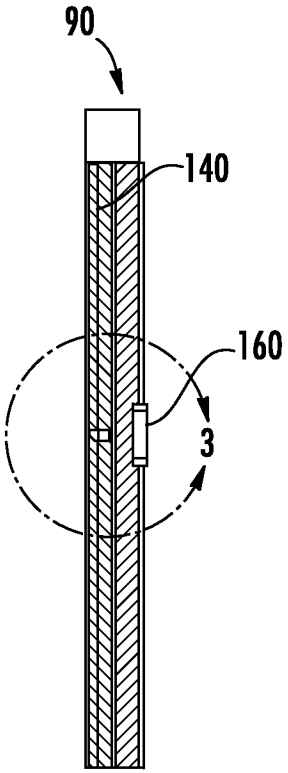
FIG. 2 is a cross-sectional side view of FIG. 1.
Figure 3:
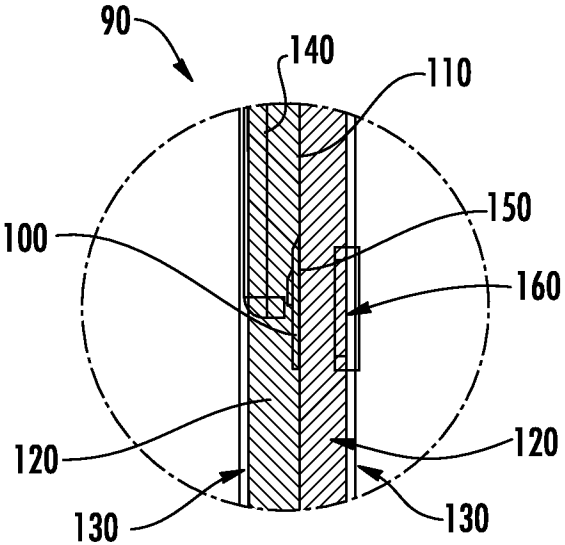
FIG. 3 is an enlarged cross-section of FIG. 1.

Conductive adhesive patches 100 will improve and ensure the connection point between a conductive center screen 110 sparse material and a probe 140, as shown in FIG. 1. The conductive patches 100 can be metal foil or sheet, and may be include a plastic backing to ensure they keep a uniform shape. If the patch 100 is backed with a plastic material, the plastic material would include a passthough to allow the patch to receive a charge from a conductive probe 140.

The conductive patches 100 could be any conductive material. Aluminum foil adhesive tapes and die-cut parts are a readily available and inexpensive option that is presently preferred. The figures show a circular-shaped piece of aluminum foil applied to and extruded conductive plastic netting, but could obviously be applied to other material types and shapes.

In use, the adhesive-backed conductive patch 100 attaches to a conductive center screen 110 that separates two filter media 120. Ground screens 130 on either side of the filter media 120 act to ground the entire filter assembly 90. A probe 140 delivers voltage from a voltage source through the filter assembly 90 to the conductive patch 100.

The voltage contact between the probe 140 and the conductive patch 100 is made through a contact point 150 on the probe 140. The contact point 150 could have a sharp point and pierce the media 120 and the patch 100. Alternatively, the contact point 150 could be blunt or rounded and simply make contact with the patch 100. The contact point 150 may itself have some adhesive applied thereto that contacts the patch 100 to minimize the chance of a lost connection. This adhesive would itself either be conductive or only surround the contact point, not insulated the contact point more than necessary. Alternatively, the contact point 150 and patch 100 may be connected through a magnetic connection.

In some instances, the media 120 would have to be sparse enough to allow for contact therethrough. Alternatively, the media may be cut away to allow a clear path for the probe. In one embodiment, there may be an insulating element 160 on the opposite ground screen 130 in an area proximate to the contact to prevent short of the high voltage to ground. This insulating element 160 could also be attached to the center of the filter media 120 or elsewhere. Another embodiment of an insulating element could act as a spacer located on an opposite side of the center screen 110 from the patch, where the spacer ensures the center screen does not short.

As shown, the conductive patch 100 is oblong to allow for some variability in placement with different sizes and types of media pads and filter frames. The conductive patch 100 could be smaller if the relationship between the filter assembly 90 and the high voltage probe 140 was uniform. The conductive patch 100's rounded edges minimize the potential of voltage spraying and arcing. The patch 100 may also be a splined shape with arms that extend outwards from a center.

Figure 4A:
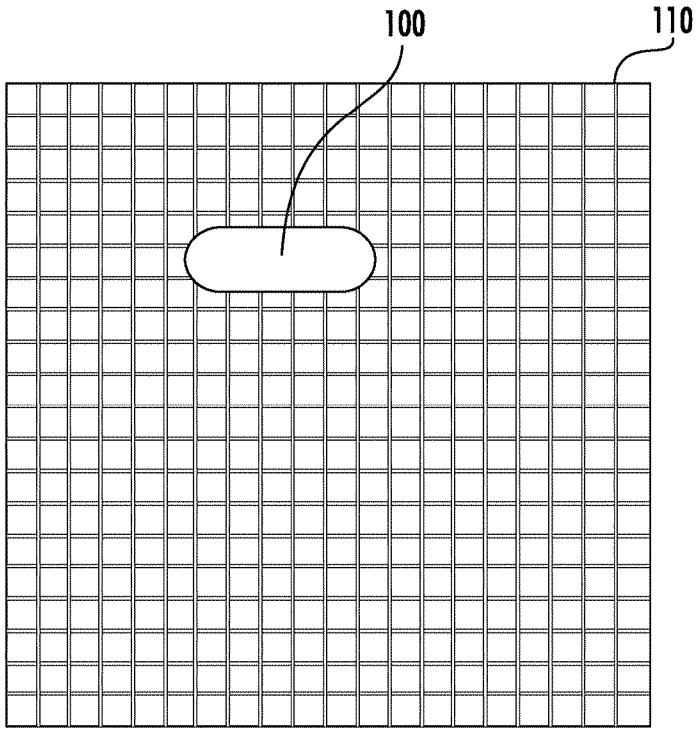
FIGS. 4*a-c* show different views of the disc applied to both sides of a conductive screen.
Figure 4B:
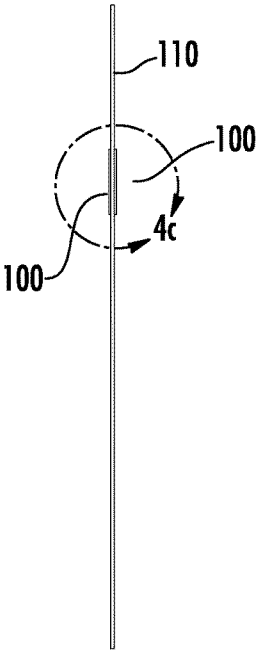
Figure 4C:
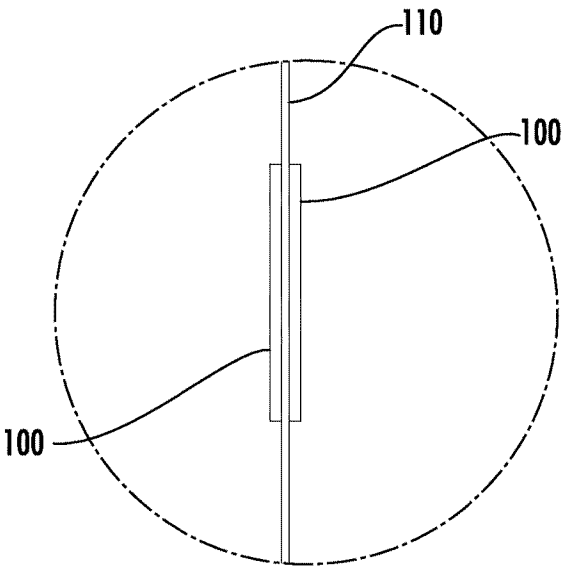
Figure 5C:
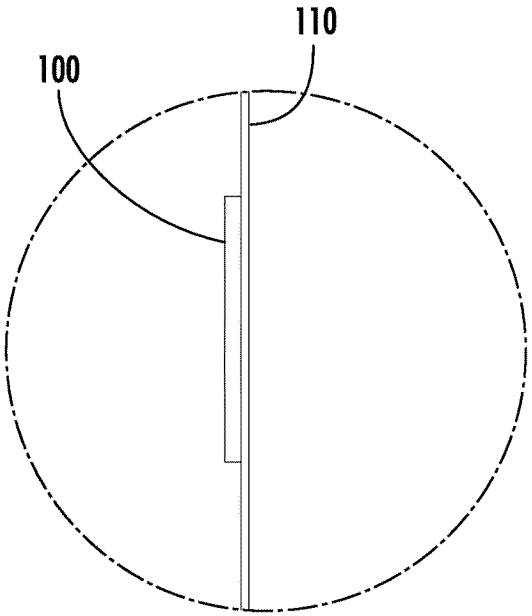
FIGS. 5*a-c* show different views of the disc applied to a single side of a conductive screen.
Figure 5B:
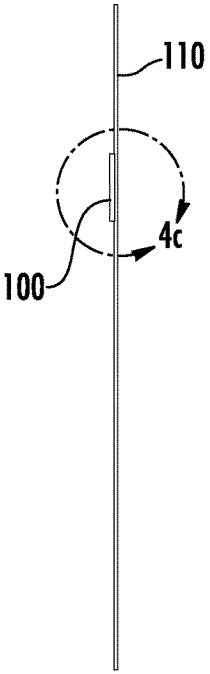
Figure 5A:
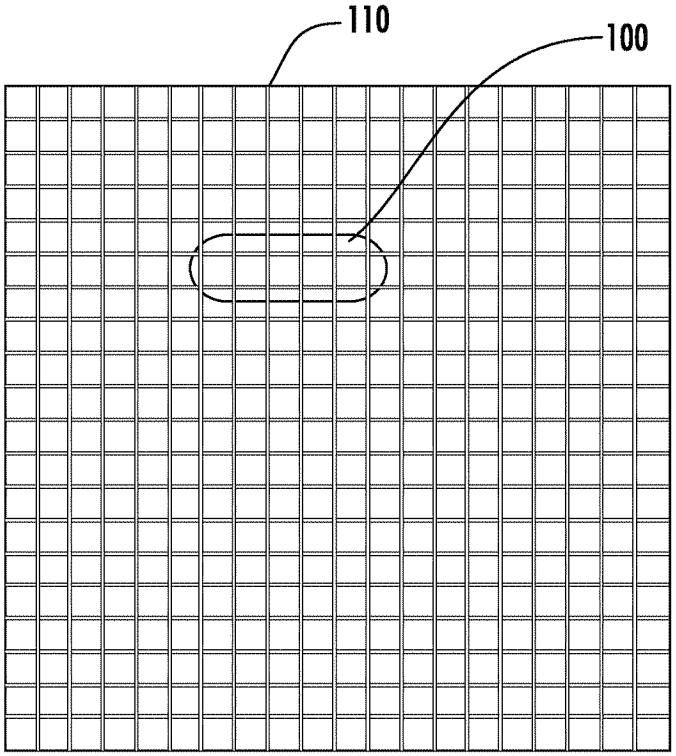

The conductive patch 100 could be applied to both sides of the center screen 110 (first and second patches applied separately) as shown in FIGS. 4*a-c* or to one side as shown in FIGS. 5*a-c*. The advantage of the former would be in the event of a sparser center screen 110 material, the two patches 100 would hold each other in place through the connection of their adhesives to one another through the gaps in the center screen 110. Alternatively, the patch 100 opposite the probe 140 could be made of an insulating material and could serve to replace the insulating element 160. The center screen 110 itself could be any of a variety of conductive materials.

While the embodiments shown relate to air cleaners, there will be other applications for such a contact where a positive electrical connection to a sparse or woven material or substrate or extruded plastic net is required.

While the invention has been described with reference to the embodiments above, a person of ordinary skill in the art would understand that various changes or modifications may be made thereto without departing from the scope of the claims.

The invention claimed is:

1. A filter assembly for an active field polarized media air cleaner comprising:

a conductive screen that conducts a high voltage therethrough;

a probe that delivers voltage to the conductive screen; and a conductive patch attached to the conductive screen, wherein the probe delivers the high voltage to the conductive screen through the conductive patch, wherein the patch has rounded edges and is separate and distinct from the conductive screen, further comprising a second conductive patch applied to an opposite side of the conductive screen, wherein each patch comprises a conductive portion and each patch's conductive portion faces away from the other patch.

2. The filter assembly of claim 1, further comprising filter media located on either side of the conductive screen.

3. The filter assembly of claim 2, further comprising ground screens on either side of the conductive screen.

4. The filter assembly of claim 3, further comprising an insulating element attached to at least one of the ground screens in an area of the ground screen near the probe, wherein the insulating element prevents a short of the high voltage to ground.

5. The filter assembly of claim 2, wherein at least one of the filter media pads includes a hole therethrough, wherein the probe extends through the hole to contact the conductive patch.

6. The filter assembly of claim 1, further comprising a ground screen that grounds the assembly.

7. The filter assembly of claim 1, wherein the conductive patch comprises an aluminum foil.

8. The filter assembly of claim 1, wherein the conductive patch comprises a metal sheet.

9. The filter assembly of claim 1, wherein the conductive patch comprises a conductive plastic.

10. The filter assembly of claim 1, wherein the conductive patch comprises a conductive portion attached to a backing.

11. The filter assembly of claim 1, wherein the patch comprises splines reaching outwards from a central portion of the patch.

12. The filter assembly of claim 1, wherein the probe and conductive patch engage one another through an adhesive.

13. The filter assembly of claim 1, wherein the second conductive patch is in electrical contact with the conductive patch.

14. The filter assembly of claim 1, wherein the second conductive patch is adhesively connected to the conductive patch through gaps in the conductive screen.

15. The filter assembly of claim 1, wherein the second patch is applied to an opposite side of the conductive screen is an insulator.

16. The filter assembly of claim 1, further comprising an insulating spacer on an opposite side of the conductive screen.

17. The filter assembly of claim 1, wherein the conductive patch is adhesively attached to the conductive screen.

18. The filter assembly of claim 1, wherein the high voltage is delivered radially out from the conductive patch.

19. The filter assembly of claim 1, wherein the conductive patch is oblong.

* * * * *